United States Patent [19]

Thompson

[11] Patent Number: 4,907,993

[45] Date of Patent: Mar. 13, 1990

[54] OUTBOARD MOTOR MOUNTING APPARATUS

[76] Inventor: William V. Thompson, Rte. 3, Box 73, Perry, Fla. 32347

[21] Appl. No.: 225,267

[22] Filed: Jul. 28, 1988

[51] Int. Cl.[4] ..... B63H 21/26

[52] U.S. Cl. ..... 440/61; 248/641

[58] Field of Search ..... 440/59, 61, 60; 248/640, 641, 642, 643

[56] References Cited

U.S. PATENT DOCUMENTS

| | | | |
|---|---|---|---|
| 2,928,630 | 3/1960 | Wisman | 440/59 |
| 2,928,631 | 3/1960 | Hartman | 440/59 |
| 3,191,573 | 6/1965 | Hixon | 440/59 |
| 4,482,330 | 11/1984 | Cook | 440/61 |
| 4,624,438 | 11/1986 | Goodman | 440/61 |

*Primary Examiner*—Sherman D. Basinger
*Assistant Examiner*—Stephen P. Avila
*Attorney, Agent, or Firm*—Head & Johnson

[57] ABSTRACT

An apparatus for mounting an outboard motor on the transom of a boat so that the motor can be raised and lowered on the transom even while the boat is being powered by the outboard motor. The apparatus includes a transom bracket and a motor mounting plate. The motor mounting plate is slidably mounted in channels located on the inside surface of rearwardly extending portions of the transom bracket. In a preferred embodiment the movement of the mounting plate is effected by a waterproof marine electromechanical unit.

17 Claims, 4 Drawing Sheets

OUTBOARD MOTOR MOUNTING APPARATUS

FIELD OF THE INVENTION

The present invention relates generally to improvements in the art of marine propulsion and, more particularly, to apparatus for vertically positioning outboard motors on the transoms of boats.

BACKGROUND OF THE INVENTION

It is generally accepted that an outboard motor should be mounted on the transom of a boat such that the cavitation plate of the motor runs across the surface of the water while the boat is being operated. At such a height, the cavitation plate will be appropriately positioned to carry out its function of preventing air from reaching the propeller area, thereby preventing cavitation or slippage of the propeller in the water that can reduce the efficiency of operation of the motor, while at the same time the water will produce only a minimum drag on the motor to be overcome by the motor during the operation of the boat.

However, when a boat is to be used for a variety of purposes, it is often found impractical to have the motor mounted in that manner. For example, an appropriate height setting for the motor where a boat is to be used as a work boat, operating at a relatively low speed but requiring maximum thrust, is generally such that the cavitation plate will be positioned one to three inches higher than the bottom of the boat. This same setting, however, would not be appropriate where the boat should, at some time be used for racing purposes. At the higher speeds involved in racing, the stern of the boat is lower in the water requiring a setting of the cavitation plate generally of the order of three to five inches above the bottom of the boat to prevent excessive drag and to permit maximum speed to be obtained with propellers designed especially for racing purposes.

Some attempts have in the past been made to provide a outboard motor mounting apparatus which will allow for the motor to be quickly raised or lowered as might be desired for a particular application. Examples of such devices are disclosed in U.S. Pat. Nos. 4,232,627 and 4,482,330, the disclosures of which are incorporated herein by reference. Such devices are often referred to as transom jacks or motor jacks or outboard engine jacks. Most of the prior devices of that type are mechanically quite complicated.

An object of the present invention is to provide an outboard motor mounting apparatus which can be used to raise and lower the outboard motor relative to the transom of a boat.

Another object of the present invention is to provide an outboard motor mounting apparatus that has an attractive appearance and a minimum number of parts which are subject to being damaged or loosened by the employment of the device.

A further object of the present invention is to enable adjustment of the operating characteristics of an outboard motor powered boat while the boat is in operation to match the operation of the boat and the motor to instantaneously occurring conditions exiting during the operation of a boat.

Other objects, advantages, and features of the present invention will become clear from the following description when read in conjunction with the drawings and the appended claims.

SUMMARY OF THE INVENTION

In accordance with the present invention there is provided an apparatus for raising and lowering an outboard motor relative to the transom of an associated boat. The apparatus comprises a transom bracket mountable on a boat transom, a motor mounting plate slidably mounted on the transom bracket for receiving a motor thereon, and means for sliding the motor mounting plate relative to the transom bracket whereby a motor mounted on the motor mounting plate can be raised and lowered. The inventive transom bracket comprises two side plates extending rearward of the transom. The side plates each have on the inside surface thereof a longitudinal channel parallel with the line of movement of the motor mounting plate. The opposite side edges of the motor mounting plate are located within a respective channel of said side plate. The apparatus further includes adjusting means for adjustably moving at least a portion of at least one of said side plates toward the other said side plate so as to provide a selected amount of force on the motor mounting plate.

DETAILED DESCRIPTION OF THE INVENTION

Figure 2:
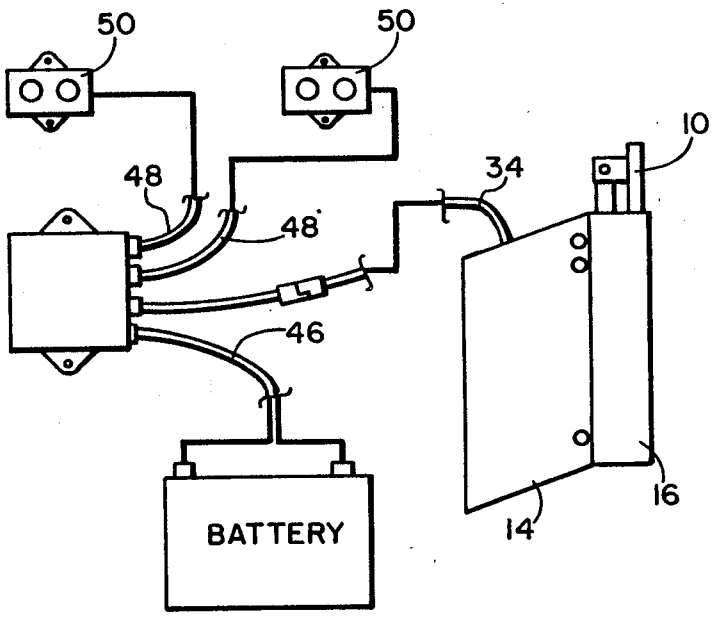
FIG. 2 is a diagramatic view of the apparatus along with related control wiring.
Figure 1:
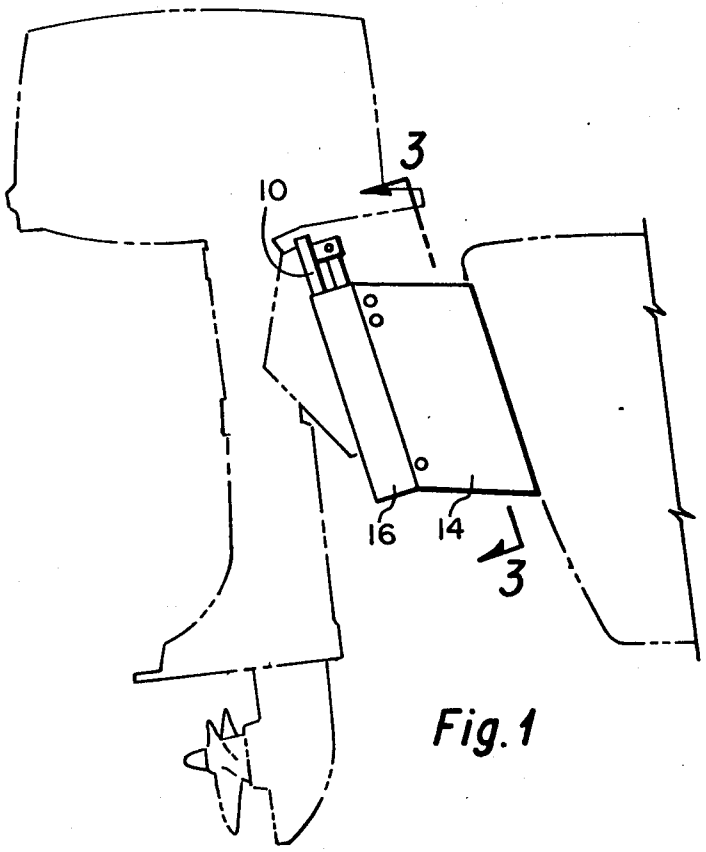
FIG. 1 is a side view of a preferred embodiment of the present invention showing the relative positions of the inventive transom jack, the transom of a boat to which the jack is mounted, and a motor mounted to the jack.

Further understanding of the present invention and its objects and advantages will be provided by referring to the drawings of FIGS. 1 through 5 which illustrate a preferred embodiment of the present invention.

In the illustrated embodiment the outboard engine jack includes a motor mounting plate 10 and a pair of generally L-shaped transom brackets. Each L-shaped transom bracket includes a rear transom plate 12 having holes therein to allow for the plate to be mounted on a boat transom. The side plates of each transom bracket includes a rear side plate portion 14 and a front side plate position 16. The rear side plate portion, in the illustrated embodiment, is integral with the respective transom plate. The front and rear side plate portions of each transom bracket are positioned in an overlapping relationship so that respective the front side plate portion 16 is located inside the respective rear side plate portion 14. Note the beveled free ends of the overlapping side plate portions. These beveled ends provide for assistance in the adjustments to be described in some detail below.

The front side plate portion 16 of each side plate has on its inside surface a channel 18. In this preferred embodiment the channel 18 includes a channel bearing surface 20. The bearing surface 20 is composed of a normally solid synthetic polymer. Typical examples of suitable polymers include those known in the art as having a friction reducing effect, such as polyphenylene sulfide, polyester, polyethylene, polyamines, polytetrafluoroethylene, and the like. Some specific examples would include those polymeric materials which have been sold under the tradenames UHMW, nylon, or teflon.

Figure 3:
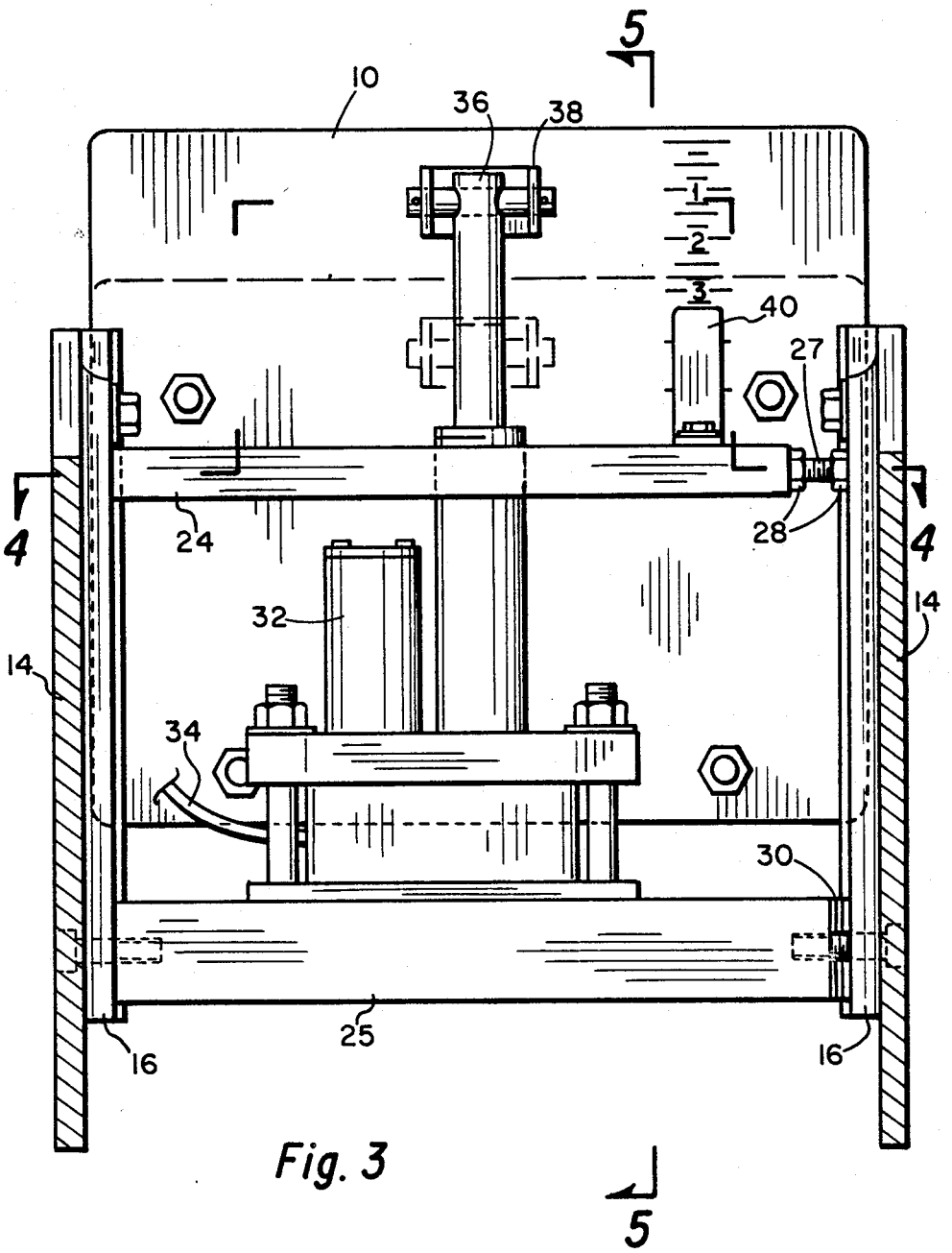
FIG. 3 is a cross-sectional end view of the jack of FIG. 1 taken along lines A—A of FIG. 1 illustrating different positions for the motor mounting plate.
Figure 4:
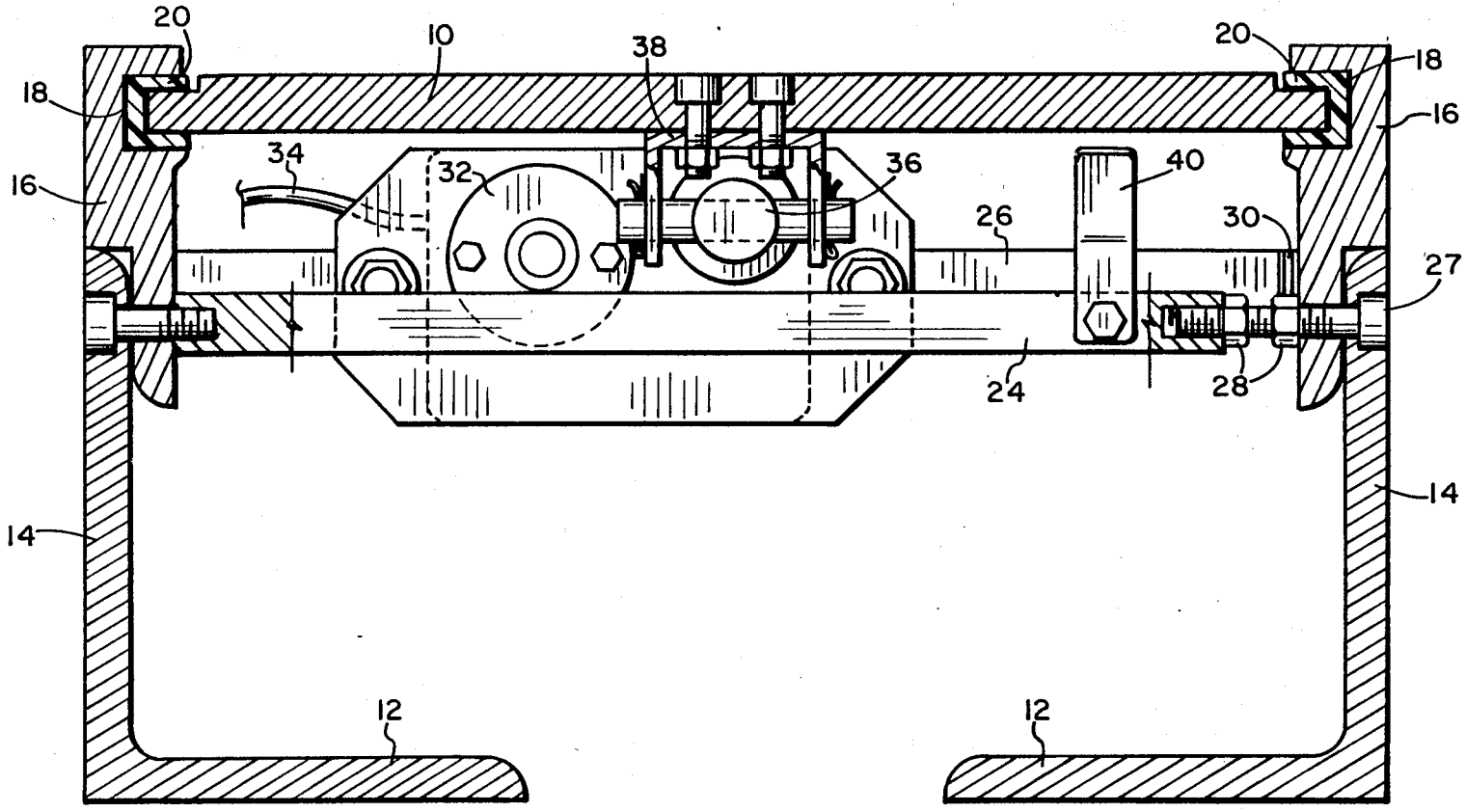
FIG. 4 is a partial cross-section top view with a cross-section taken along lines B—B of FIG. 3.
Figure 5:
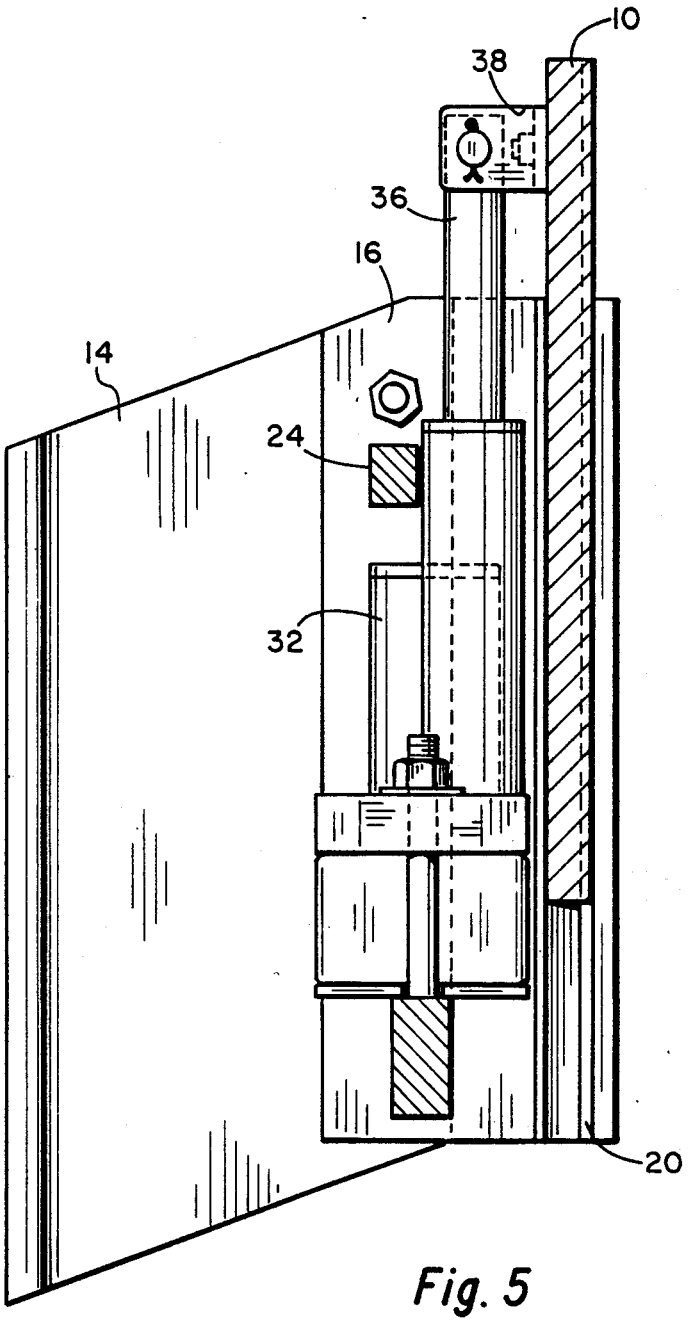
FIG. 5 is a cross-sectional side view take through lines C—C of FIG. 3.

The motor mounting plate 10 has holes therein which can be used for mounting the motor to the mounting plate via bolts passed through the plate and through brackets of the motor as shown in FIG. 3. Generally, these holes would be located in a standard BIA bolt pattern.

The opposite side edges of the mounting plate 10 are located within the polymer bearing channel 20 for sliding engagement with the surface of the bearing channel.

Upper and lower adjusting blocks 24 and 26 are located between the opposite side plates of the transom bracket. The adjusting blocks are attached to the side plates by Allen-headed bolts which extend through the overlapped portions of the side plates and into the ends of the adjusting blocks. On one side the adjusting blocks are secured flush with the inside of the front side plate. On the opposite side the adjusting blocks do not quite reach the inside of the side plate.

The upper adjusting block 24 is separated from the sidewall a sufficient distance to allow for two lock nuts 28 to be positioned on the Allen bolt 27 that attaches that end of adjusting block 24 to the respective side plate. Through this arrangement the Allen bolt 27 can be adjusted to provide the desired amount of separation of the side plates and then the lock nuts can be positioned as shown to lock the bolt and adjusting block in position.

The lower adjusting block 26 employs shims 30 which fit over the bolt which connects that end of adjusting block 26 to the respective sidewall.

A waterproof marine electromechanical unit comprising a motor 32, an electric power wire 34, and an activating rod 36, is bolted to the lower adjusting block 26. The upper end of the activating rod 36 is in turn secured to the mounting plate 10 by a bracket 38 secured to the mounting plate. The activating rod is a device which is raised and lowered in response to the electric motor 32. The particular mechanical arrangement used in this activation can vary. A typical arrangement would include a worm gear arrangement driven by a reversible electric motor. A currently preferred electromechanical unit is one of the type disclosed in U.S. Pat. No. 4,687,448, the disclosure of which is incorporated herein by reference. While it is within the scope of the present invention to use a hydraulically actuated mounting plate, the electromechanical device is preferred since with such a device there are no hydraulic pumps to fill and monitor and there are no bulky hoses to contend with. In addition, the electromechanical device eliminates the problem of hydraulic fluid leakage that often accompanies the use of hydraulic actuating devices.

On the upper adjusting block 24 is secured an upwardly extending tab 40. This tab 40 is used in conjunction with numerical indica located on the back of the mounting plate to allow one to visually check the height of the motor.

In the preferred embodiment the electric power 34 wire of the motor 32 is connected to a junction box which in turn is connected to a source of electricity, generally a marine or auto DC battery by a wire 46. The junction box preferably also contains plugs for wires 48 which will allow for control switches 50 to be located at different positions on the boat, as illustrated in FIG. 2.

The actual materials employed and the relative dimensions can vary widely. It is however currently preferred to construct the transom jack of 6061-T6 aluminum alloy. It is further preferred for the transom jack to have a height of about 17 inches and a width of about 14 to 15 inches. An electromechanical actuator having a lifting capacity of at least about 1,000 pounds is preferred. A typical stroke length for the acutating rod would be about 5 to 6 inches. Preferably the actuator would be capable of causing the rod to move about 5½ inches in about 15 seconds. The set back, i.e. the distance from the motor mounting plate to the transom can vary; however, the currently preferred embodiment employs a set back of either about 5 inches or about 10 inches.

While a presently preferred embodiment of the present invention has now been described for the purpose of illustration, it should be recognized that there are various modifications and changes will be apparent to one skilled in this art which are within the scope and spirit of the invention herein described and claimed.

What is claimed is:

1. An apparatus for raising and lowering an outboard motor relative to the transom of an associated boat, comprising a transom bracket mountable on a boat transom; a motor mounting plate, slidably mounted on the transom bracket for receiving a motor thereon and means for sliding the motor mounting plate relative to the transom bracket whereby a motor mounted on the motor mounting plate can be raised and lowered; wherein the transom bracket comprises two side plates extending rearward relative to the transom, wherein the side plates each have on the inside surface thereof a longitudinal channel within which opposite side edges of the motor mounting plate are located, said channels having a normally solid synthetic organic polymer bearing surface extending throughout the total length of said channel and contacting the front and rear faces of said mounting plate as well as the side edges of said mounting plate; said apparatus further including adjusting means for adjustably moving at least a portion of at least one of said side plates toward the other said side plate so as to provide a selected amount of force on the motor mounting plate.

2. An apparatus according to claim 1 further including a junction box having inlet wiring capable of transmitting electricity from a battery to said junction box, outlet wiring capable of transmitting electricity from said junction box to said electromechanical device, and at least one switch for controlling the flow of electricity from said inlet wiring to said outlet wiring.

3. An apparatus according to claim 1 wherein said means for sliding the motor mounting plate relative to the transom bracket includes an electromechanical device.

4. An apparatus according to claim 3 wherein said electromechanical means comprises an electric motor and a rod attached to said mounting plate, said rod being capable of being moved up and down by said motor so as to effect movement of said mounting plate relative to said transom bracket.

5. An apparatus according to claim 4 wherein said transom bracket is composed of two generally L-shaped components in which one side of the L is a side plate and in which the other side of the L is a transom plate adapted for mounting to the transom of a boat.

6. An apparatus according to claim 5 wherein said means for sliding the motor mounting plate relative to the transom bracket includes an electromechanical device.

7. An apparatus according to claim 5 wherein each side plate has a rear portion which is integral with and intersects said transom plate and a separate front portion which contains the channel which holds said mounting plate, said front portion and said rear portion of each side plate overlapping with the respective front portion being located inside relative to said two rear portions.

8. An apparatus according to claim 7 wherein said adjusting means comprises at least one bar extending from the inside of one of said front portions of one of said side plates to the inside of the front portion of the other of said side plates, said bar being secured to said front portion of said side plate and including means allowing for the distance between said front portions of the side plates to be adjusted.

9. An apparatus according to claim 8 wherein the polymer of said bearing surface is selected from polytetrafluoroethylene, polyester, polyamide, or polyphenylenesulfide.

10. An apparatus according to claim 6 wherein said electromechanical means comprises an electric motor and a rod attached to said mounting plate, said rod being capable of being moved up and down by said motor so as to effect movement of said mounting plate relative to said transom bracket.

11. An apparatus for raising and lowering an outboard motor relative to the transom of an associated boat, comprising a transom bracket mountable on a boat transom; a motor mounting plate, slidably mounted on the transom bracket for receiving a motor thereon and means for sliding the motor mounting plate relative to the transom bracket whereby a motor mounted on the motor mounting plate can be raised and lowered; wherein the transom bracket comprises two generally L-shaped components in which one side of the L is a side plate extending rearward relative to the transom, wherein the side plates each have on the inside surface thereof a longitudinal channel within which opposite side edges of the motor mounting plate are located and in which the other side of the L is a transom plate adapted for mounting to the transom of a boat, each side plate having a rear portion which is integral with and intersects said transom plate and a separate front portion which contains the channel which holds said mounting plate, said front portion and said rear portion of each side plate overlapping with the respective front portion being located inside relative to said two rear portions; said apparatus further including adjusting means for adjustably moving at least a portion of at least one of said side plates toward the other said side plate so as to provide a selected amount of force on the motor mounting plate.

12. An apparatus according to claim 11 wherein said adjusting means comprises at least one bar extending from the inside of one of said front portions of one of said side plates to the inside of the front portion of the other of said side plates, said bar being secured to said front portion of said side plate and including means allowing for the distance between said front portions of the side plates to be adjusted.

13. An apparatus according to claim 12 wherein said channel comprises a normally solid synthetic organic polymer bearing surface.

14. An apparatus according to claim 13 wherein said bearing surface extends throughout the total length of said channel and contacts the front and rear faces of said mounting plate as well as the side edges of said mounting plate.

15. An apparatus according to claim 13 wherein the polymer of said bearing surface is selected from polytetrafluoroethylene, polyester, polyamide, or polyphenylenesulfide.

16. An apparatus according to claim 12 wherein said means for sliding the motor mounting plate relative to the transom bracket includes an electromechanical device.

17. An apparatus according to claim 16 wherein said electromechanical means comprises an electric motor and a rod attached to said mounting plate, said rod being capable of being moved up and down by said motor so as to effect movement of said mounting plate relative to said transom bracket.

* * * * *